United States Patent [19]

Robertson

[11] Patent Number: 4,479,338

[45] Date of Patent: Oct. 30, 1984

[54] BUILDING ELEMENTS AND METHOD OF CONSTRUCTING A BUILDING

[76] Inventor: Gordon M. Robertson, 9 Flint Rd., Marandellas, South Africa

[21] Appl. No.: 319,116

[22] Filed: Nov. 9, 1981

[30] Foreign Application Priority Data

Oct. 2, 1981 [GB] United Kingdom ..... 8129872

[51] Int. Cl.[3] ..... E04B 2/40

[52] U.S. Cl. ..... 52/426; 52/428; 52/431; 52/432; 52/565; 52/743

[58] Field of Search ..... 52/431, 424, 428, 432, 52/426, 587, 565, 563, 743

[56] References Cited

U.S. PATENT DOCUMENTS

| | | | |
|---|---|---|---|
| 766,350 | 8/1904 | Slultz | 52/587 X |
| 1,414,425 | 5/1922 | Lewis | 52/587 |
| 1,425,117 | 8/1922 | Lynde | 52/432 |
| 1,468,285 | 9/1923 | Dampney | 52/565 X |
| 1,697,744 | 1/1929 | Winston | 52/432 X |
| 1,794,678 | 3/1931 | Eastman | 52/426 X |
| 1,911,626 | 5/1933 | Larzelere | 52/426 X |
| 1,923,645 | 8/1933 | Thompson | 52/431 |
| 2,126,309 | 8/1938 | Cade | 52/431 X |
| 2,499,886 | 3/1950 | Stevens | 52/432 X |
| 3,321,884 | 5/1967 | Klaue | 52/426 X |

FOREIGN PATENT DOCUMENTS

| | | | |
|---|---|---|---|
| 16533 | 2/1934 | Australia | 52/583 |
| 205947 | 2/1957 | Australia | 52/432 |
| 1899117 | 8/1952 | Fed. Rep. of Germany . | |
| 986926 | 4/1951 | France . | |
| 313919 | 7/1956 | Switzerland . | |
| 149386 | 8/1920 | United Kingdom | 52/563 |
| 150433 | 9/1920 | United Kingdom | 52/424 |

*Primary Examiner*—Alfred C. Perham

*Attorney, Agent, or Firm*—Weingarten, Schurgin Gagnebin & Hayes

[57] ABSTRACT

A moulded building sheet (1) has opposed side edges (5) of increased thickness with respect to the general thickness of the sheet. The thicker side edges each accommodate a rebate (6) which extends along the respective side edge and into which the free ends of reinforcing wires (7) project. The rebates (6) and projecting portions of the wires (7) together form means for joining adjacent sheets together, the wires of one sheet being twisted into engagement with the wires of anoth

5 Claims, 9 Drawing Figures

BUILDING ELEMENTS AND METHOD OF CONSTRUCTING A BUILDING

This invention relates to building elements and to a method of constructing a building employing said elements.

At present, in many cases, the walls of buildings are constructed either of bricks or of concrete appropriately restrained during setting by shuttering. In both cases skilled labour is required either to lay the bricks or to assemble the shuttering. Moreover, once the walls have been built the inside surfaces still need to be plastered to produce the desired interior finish.

According to the present invention there is provided a building unit comprising two moulded portions having confronting inner surfaces characterised in that one or more rebates are formed along each of two opposed side edges of each portion and opening onto the outer surface of the respective portion, and connecting means are provided in the said rebates along the side edges of the portions, the connecting means of a first building unit being interconnectable with the connection means of a second building unit to connect the two building units together.

Preferably the building unit is a wall panel comprising two moulded sheets spaced apart by suitable spacing means. Such a panel forms high quality permanent shuttering for a core material, the outer surfaces of the sheets producing the desired inner and outer surfaces without the need for further plastering or finishing. Thus, the use of a building panel in accordance with the invention enables walling to be produced with unskilled labour. Alternatively the building unit may be a window or a panel.

According to another aspect of the invention there is provided a moulded building sheet adapted to be assembled in spaced apart relation with another similar sheet to form a cavity wall wherein the sheet has inner and outer surfaces with two opposite side edges characterised in that a rebate is formed in each side edge at the corner where the side edge meets the outer surface of the sheet and that reinforcing wires project from each of the rebates along the side edges of the sheet whereby when two similar sheets are assembled in side by side relation with their rebates facing outwardly the wires projecting from one sheet may easily be connected to the wires projecting from the other sheet.

The invention also includes a building panel comprising two sheets assembled in spaced apart relation with one another to form a cavity wall each sheet having inner and outer surfaces with two opposite side edges, a rebate formed in each side edge at the corner where the side edge meets the outer surface of the sheet, reinforcing wires which project from each of the rebates along the side edges of the sheet, and a plurality of loops which project from the inner surface of the sheet and spacing ties for holding the two sheets together at a desired cavity spacing, a spacing tie including a first hooked portion which engages with a loop on one sheet, and a second hooked portion which engages with a respective loop on the other sheet, and resilient means for resisting disengagement of the tie from the loops.

In order to produce solid walling the method includes the additional step of filling the space between the spaced sheets of the panels with core material.

The invention will now be described by way of example with reference to the accompanying drawings in which.

Figure 3A:
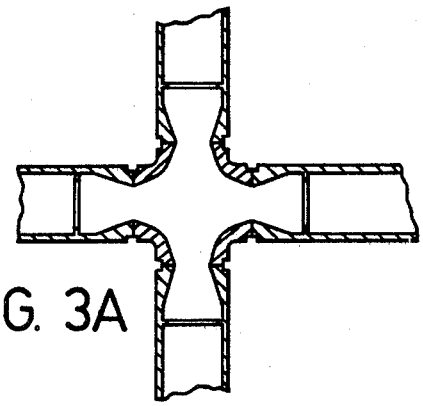
Figure 3B:
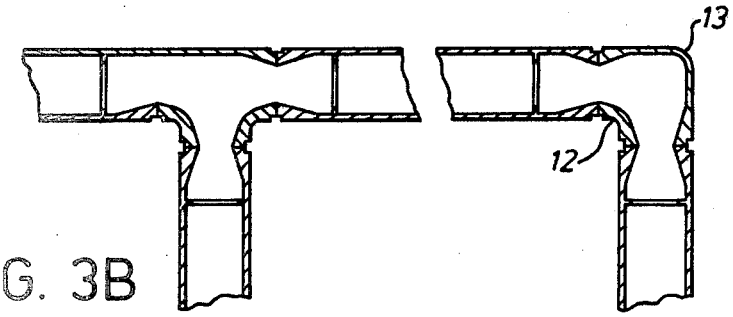
Figure 4:
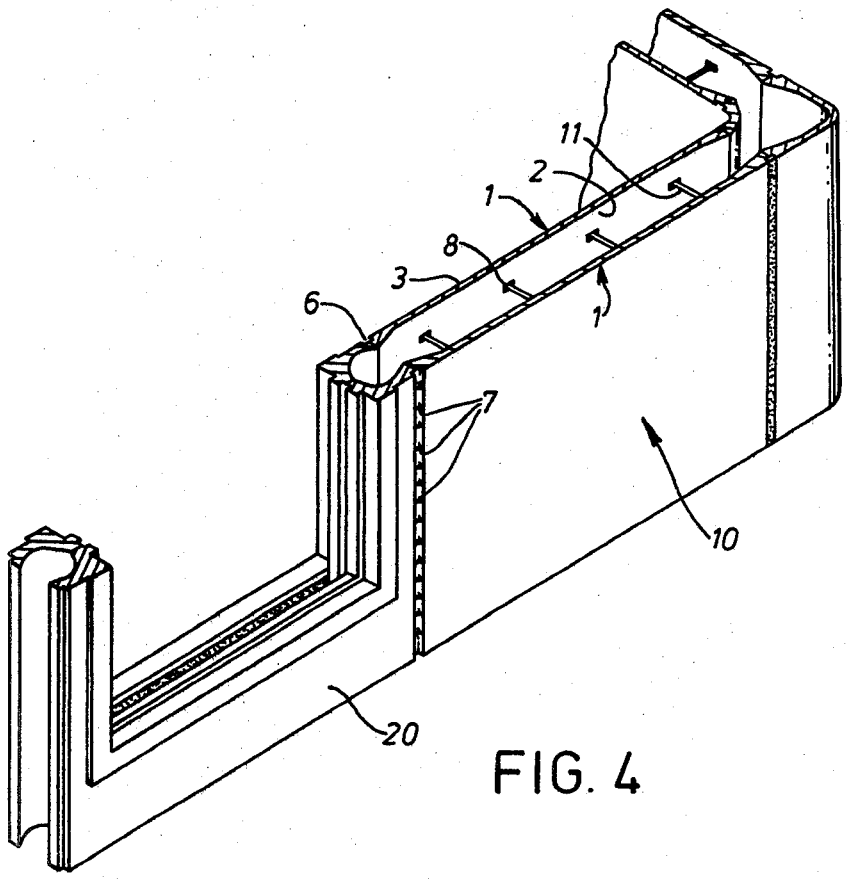
Figure 5:
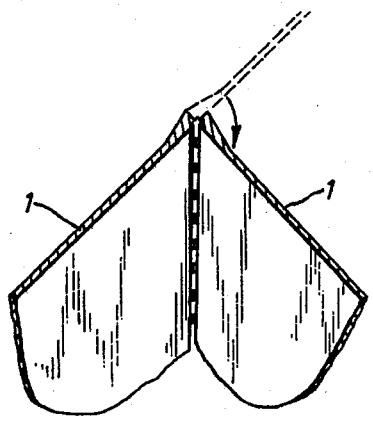
Figure 6:
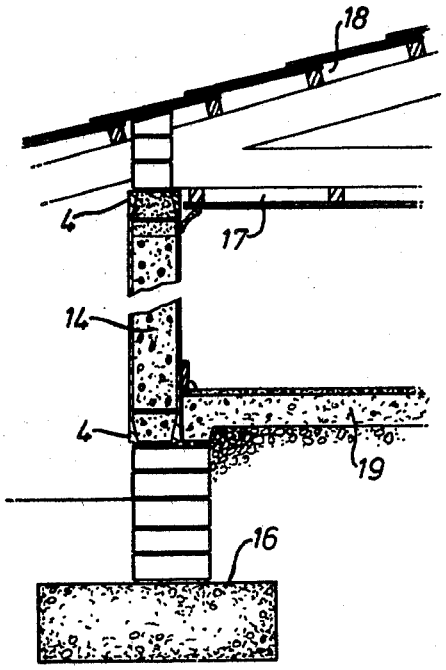
Figure 7:
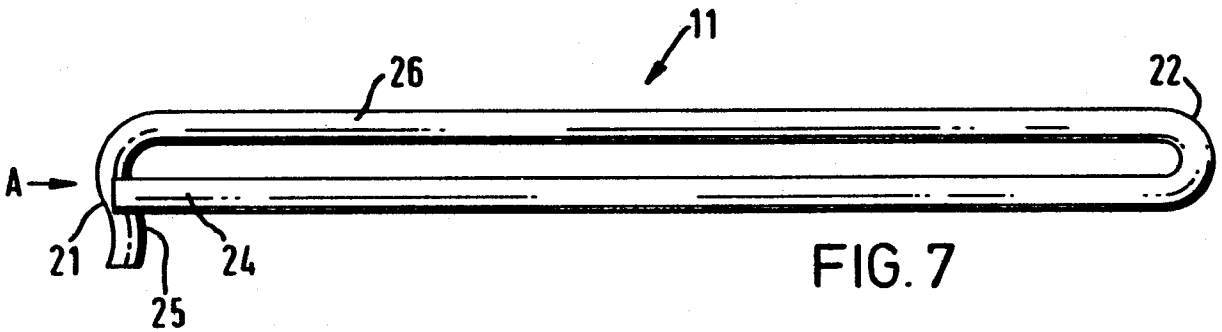
Figure 8:
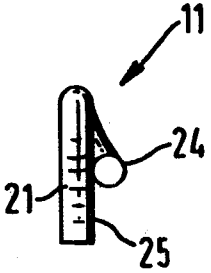

FIGS. 3*a* and 3*b* illustrate in plan different types of wall junctions in a building incorporating panels in accordance with the invention;

FIG. 4 is a perspective view of a junction between a panel and a window panel;

FIG. 5 illustrates the preferred method of forming corners;

FIG. 6 is a sectional side elevation of a single-storey building constructed with panels in accordance with the invention;

FIG. 7 is a side elevation of a preferred tie for retaining two sheets together at a desired spacing; and FIG. 8 is a view in the direction of arrow A in FIG. 7.

In the drawings a preferred sheet 1 is moulded of cement based material and has inner and outer surfaces 2 and 3 defined by top and bottom edges 4 and side edges 5. The side edges 5 of the sheet 1 are of increased thickness and are moulded with a rebate 6 at the outer surface 3 of the sheet. The rebate 6 is of a width of about 20 mm and a depth approximately equal to the general thickness of the rest of the sheet eg 10 mm. The thicker side edges 5, whilst accommodating the rebates 6, also provide structural stability at the edges. The sheet 1 is reinforced with laterally-extending reinforcing wires 7 which project into and beyond the rebates 6 at the side edges 5 of the sheet and which together with the rebates 6 form means for joining sheets together as explained below. The sheet 1 also includes loops 8 which project from the inner surface 2 of the sheet for a purpose also described more fully below. Preferably these loops 8 are formed by some of the reinforcing wires 7 being bent into a configuration which causes the loops 8 to project outside the plane of the sheet when it is being cast.

As seen in the drawings a building panel 10 consists of two spaced sheets 1, metal ties or spacers 11 being clipped in place between adjacent loops 8 projecting from the confronting inner surfaces of the respective sheets.

It has now been found that, in order to faciliate assembly of a panel, the metal ties or spacers 11 must be of a particular general configuration as shown in FIGS. 7 and 8 so that undue delay is not caused by the fitting of the ties. As can be seen from FIGS. 7 and 8 a tie is substantially elongate and may be of any length according to the width of cavity desired. The tie consists of a wire 26 of round cross-section which has one end 21 bent at right angles to the general longitudinal direction of the tie and which is bent back on itself intermediate its ends at 22 so that the other end 24 overlies the one end 21. The end 24 projects just beyond the end 21 and to one side so that opening of the tie 11 to receive the loops 8 is easily achieved. The one end 21 is formed with a slight kink 25 to define a recess for the respective loop 8 received at that end and thereby help discourage release thereof.

During assembly of a panel the ties 11 are first clipped onto the protruding loops 8 of one sheet and left hanging down. The second sheet is then brought into a confronting position and the ties 11 are clipped onto the respective protruding loops 8 on the second sheet with the one end 21 projecting downwardly. This is achieved simply, by just pushing the two ends 21 and 24 apart to allow the respective loop 8 to enter, the ends then return to their rest position shown in FIG. 8 due to their inherent resilience.

Figure 1:
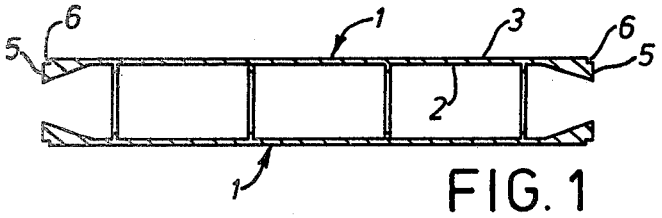
FIG. 1 is a plan view of a building panel comprising two moulded sheets or skins in accordance with the invention.
Figure 2:
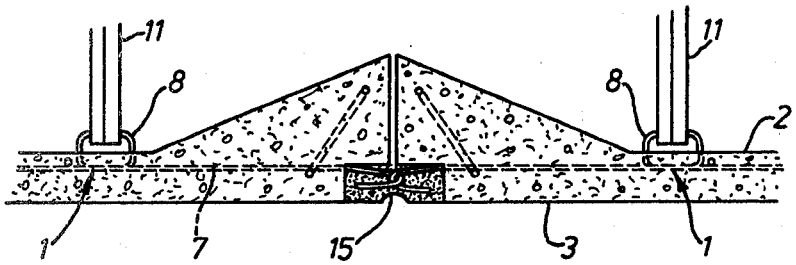
FIG. 2 is a fragmentary plan view of the joint between two adjacent moulded sheets or skins.

In order to fix two panels together they are placed with their adjacent side edges 5 abutting one another. The projecting reinforcing wires 7 of the respective sheets are then twisted together in the manner illustrated in FIG. 2: this holds the wall panels in their relative positions. If a corner is to be formed then the inside sheets of the adjacent panels may be tied with the sheets straight and then the sheets 'folded' to the desired angle as shown in FIG. 5. Alternatively an inside and outside corner piece 12 or 13 may be used as illustrated in FIGS. 3*a* and 3*b*.

When the panels 10 required to form a building have been placed in position and the joint wires are all tied together, the space between adjacent sheets can be filled with a suitable core material 14 such as concrete, "no fines" concrete, soil/cement or any other suitable strengthening or, alternatively, insulating material: the thicker side edges of the panels helping to resist any tendency of bowing at the joints between adjacent panels.

When the core material 14 has hardened the joint wires 7 are pushed into the groove 15, defined by two adjacent rebates 6, which is then filled with cement mortar which conceals the joint.

FIG. 6 illustrates a building panel 10 in use where it is supported on a suitable foundation 16 and in turn supports a ceiling structure 17 and tiled roof 18. Although not shown, the ceiling structure may consist of single sheets supported from rafters 18. The flooring 19 suitably may be solid as shown and moulded panels for the windows and doors may be fitted as appropriate as indicated by the window panel 20 shown in FIG. 4. The window and door moulded panels such as panel 20 are also formed with rebates along their outer edges into which reinforcing wires project so that the window or door panels can be connected to the wall panels on the same way as adjacent wall panels are connected together.

In use the sheets 1 have the dual purpose of firstly forming shuttering for solid core material 14 and then forming internal decoration and external weather proofing.

The moulds for the sheets, having a size, shape and negative texture to that required of the finished sheet, contain a detachable perimeter frame/s which allow the reinforcing wires to be placed and held in position the required distance from the face of the mould. The wires are woven and pulled taut and the mix suitably cement mortar, ie a mixture of cement, sand and water, is poured into the mould to give the required thickness of skin. The whole mould is vibrated to cause the mixture to settle.

As indicated above the sheets can be moulded to form openings in the walls such as window surrounds, reveals and frames or door architraves, reveals and frames. Water drips, weathering angles, sills etc can be incorporated in the moulding as can hinged recesses and locking device plates. The sheets can be moulded to form inside and outside corners at right/obtuse angles. The sheets can be moulded in the form of curves to produce a circular or compound curved wall plan. Also, although straight sheets have been disclosed, the sheets can be moulded to form walls the surface of which is an induced curve, eg an hyperbolic-parabaloid.

The surface of the sheet can have the texture produced by a suitably textured mould for example to simulate brickwork. The surface layer of the sheets may be coloured and include a waterproofing agent.

The sheets may be moulded to accommodate "services " such as electrical points, conduits, water and sewerage fittings, pipes, soap holders in bathrooms and kitchens etc. Although it is preferred to provide a single rebate along each side alternatively separate rebates associated with each reinforcing wire may be provided if desired.

I claim:

1. A building unit, comprising:

two molded cavity wall portions having confronting inner surfaces, each cavity wall portion having enlarged ends having a thickness greater than the thickness of its central portion and one or more rebates formed along each of two opposed side edges onto the outer surface of the respective cavity wall portion, each cavity wall portion having integral connecting means including a longitudinally extending and embedded wire with its end freely extending in corresponding ones of each of said rebates along the side edges of the portions, the freely extending end of the embedded wire of the integral connecting means of a first building unit is twisted and bent around the freely extending end of the wire of the integral connecting means of a second building unit to mechanically connect the two building units together; and spacing and interconnecting means transversely extending between the inner surfaces of said two molded portions intermediate said opposed side edges, said spacing and interconnecting means including at least one loop integrally formed with said longitudinally extending embedded wire projecting inwardly from the inside surfaces of respective ones of said portions intermediate said side edges thereof, said spacing and interconnecting means including at least one elongated tie having a length that is selected to match the dimension defined between the confronting inside surfaces of said building unit, said at least one tie consists of a rod having a first end having a right angle bend that is bent back on itself in intermediate its ends so that the other end thereof overlies its first end and to one side thereof forming a resilient loop, said resilient loop is inserted around corresponding ones of said loops formed in said embedded wire intermediate said sides for mechanically joining the portions together.

2. A building panel, comprising:

a first molded cavity wall having generally planar inside and outside surfaces and opposed first and second side edges of increased thickness with respect to the general thickness of the central portion of said first molded cavity wall, said first and second side edges of increased thickness having respectively first and second rebates which vertically extend along the first and second side edges;

a second molded cavity wall having generally planar inside and outside surfaces and opposed third and fourth side edges of increased thickness with respect to the general thickness of the central portion of said second cavity wall and positioned in spaced apart relation to said first molded cavity wall with the inside surface of said first cavity wall confronting the inside surface of said second cavity wall defining a cavity therebetween, said third and fourth side edges having respectively third and fourth rebates which vertically extend along the third and fourth side edges;

at least one longitudinally extending wire embedded in said first molded cavity wall with its ends respectively outwardly extending freely into said first and said second rebates of said first and said second side edges;

at least one longitudinally extending wire embedded in said second molded cavity wall with its free ends outwardly extending freely into said third and said fourth rebates of said third and said fourth side edges· each of said rebates are vertical cut-outs having an L-shaped cross-section that each open to the outside surface of the corresponding cavity walls;

at least one first arcuate portion integrally formed with said first longitudinally extending embedded wire intermediate said first and said second side edges, said first arcuate portion projecting beyond the inside generally planar surface of said first cavity wall;

at least one second arcuate portion integrally formed with said second longitudinally extending embedded wire intermediate said third and fourth side edges, said second arcuate portion projecting beyond the inside generally planar surface of said cavity wall;

said first and second arcuate portions being formed in confronting relationship on respective ones of said first and said second cavity walls;

a tiearm consisting of a preselected length of an elongated material that is arcuately bent at a point intermediate its ends to provide opposed arms, the end of one of said arms has a bight that abuts the side of the end of the other one of said opposed arms forming a resilient loop, said tiearm removably attached around said first and second confronting arcuate portions to secure said first and said second molded cavity walls together in spaced apart relationship;

the free ends of the longitudinally extending embedded wires of adjacent panels are twisted and bent around each other to mechanically connect adjacent building panels together.

3. A method of constructing the walls of a building to claim 2, comprising the steps of providing a foundation; positoning the cavity walls upon the foundation such that the first and second and third and fourth rebates extend vertically; and positioning a ceiling structure upon the cavity walls such that the building panels extend between the foundation and the ceiling of the building.

4. A method of constructing the walls of a building from moulded cavity wall according to claim 2 comprising the steps of providing a plurality of building panels by interconnecting the inner surfaces of pairs of cavity walls with said tie arm, placing the panels in relative juxtaposition so that their side edges are abutting, and twisting together the outwardly facing reinforcing wires of one panel with the outwardly facing reinforcing wires of an adjacent panel to join adjacent panels to one another.

5. A method of constructing a building according to claim 4 characterised by the additional step of filling the cavity defined between the spaced cavity walls of the panels with core material to form solid walling.

* * * * *

UNITED STATES PATENT AND TRADEMARK OFFICE

CERTIFICATE OF CORRECTION

PATENT NO. : 4,479,338

DATED : October 30, 1984

INVENTOR(S) : Gordon M. Robertson

It is certified that error appears in the above—identified patent and that said Letters Patent is hereby corrected as shown below: On the title page;

In the inventor's address: "Marandellas, South Africa" should read --Marandellas, Zimbabwe--

In the abstract: line 9, "into engagement with the wires of anoth" should read --into engagement with the wire of another sheet. Two building sheets (1) are joined together by ties (8, 11) to form a composite building panel (10). The ties are of a particular configuration which facilitates assembly.--

| | | |
|---|---|---|
| Column 4 | line 21, | "edges onto" should read --edges opening onto-- |
| | line 24, | "with its end" should read --with its ends-- |
| Column 5 | lines 31-32, | "of said cavity wall;" should read --of said second cavity wall;-- |
| Column 6 | line 4, | "of one of said arms" should read --of one of said opposed arms-- |
| | line 9, | "spaced apart" should read --spaced-apart-- |

UNITED STATES PATENT AND TRADEMARK OFFICE

CERTIFICATE OF CORRECTION

PATENT NO. : 4,479,338

DATED : October 30, 1984

INVENTOR(S) : Gordon M. Robertson

It is certified that error appears in the above—identified patent and that said Letters Patent is hereby corrected as shown below:

| | | |
|---|---|---|
| Column 6 | line 14, | "building to" should read --building according to-- |
| | line 16, | "positoning" should read --positioning-- |

Signed and Sealed this

*Fifteenth* Day of *October 1985*

[SEAL]

*Attest:*

*Attesting Officer*

DONALD J. QUIGG

*Commissioner of Patents and Trademarks—Designate*